United States Patent [19]

Moertel

[11] 4,276,680

[45] Jul. 7, 1981

[54] LOW COST SLIDE FASTENER STRINGER

[75] Inventor: George B. Moertel, Conneautville, Pa.

[73] Assignee: Textron, Inc., Providence, R.I.

[21] Appl. No.: 95,829

[22] Filed: Nov. 19, 1979

[51] Int. Cl.[3] ..... A44B 19/40

[52] U.S. Cl. ..... 24/205.16 R; 24/205.13 C; 24/205.16 C

[58] Field of Search ..... 24/205 R, 205.1 R, 205.16 R, 24/205.16 C, 205.16 D

[56] References Cited

U.S. PATENT DOCUMENTS

| | | | |
|---|---|---|---|
| 2,287,323 | 6/1942 | Poux | 24/205.16 R |
| 2,651,092 | 9/1953 | Poux | 24/205.16 R |
| 3,885,275 | 5/1975 | Hasegawa | 24/205.16 R |
| 3,905,072 | 9/1975 | Hasegawa et al. | 24/205.16 R |
| 4,045,846 | 9/1977 | Moertel | 24/205.16 C |
| 4,100,656 | 7/1978 | Moertel | 24/205.16 C |
| 4,186,467 | 2/1980 | Lawrence | 24/205.16 R |

*Primary Examiner*—Roy D. Frazier
*Assistant Examiner*—Peter A. Aschenbrenner
*Attorney, Agent, or Firm*—O'Brien and Marks

[57] ABSTRACT

A low cost slide fastener stringer is disclosed as including a tape formed from layers of diverse non-fabric synthetic polymer materials, with a row of coupling elements attached along a folded edge of the tape.

3 Claims, 6 Drawing Figures

LOW COST SLIDE FASTENER STRINGER

BACKGROUND OF THE INVENTION

1. Field of the Invention

This invention relates to slide fasteners, and particularly to a stringer tape construction for a slide fastener.

2. Description of the Prior Art

A typical slide fastener includes a pair of stringers, each having a flexible tape with a row of coupling elements attached along one edge thereof, which are joined and separated by moving a slider along the pair of stringers.

Conventional slide fasteners include stringer tapes made of a textile fabric which provides a strong yet flexible mounting for the coupling elements. Other prior art fasteners, as exemplified by U.S. Pat. Nos. 3,885,275, 4,100,656 and 3,200,462, include non-fabric materials such as plastic films in their tapes, either alone or in conjunction with woven or knitted fabrics. One reason for using plastic films in fastener tapes is that they have a substantial cost advantage over conventional tape fabrics. However, known prior art non-fabric tapes have exhibited an unacceptable tendency to tear under load, either at the mounting points for the coupling elements or at the union between the tape and the article to which it is attached. A need exists for an improved non-fabric tape (that is, one which is neither woven nor knitted) that will better resist tearing failure, yet will provide adequate flexibility and a pleasing appearance in a low cost fastener.

SUMMARY OF THE INVENTION

The invention is summarized as a low cost slide fastener stringer including a tape and a row of fastening elements attached along one edge of the tape, the tape including layers of at least two diverse non-fabric synthetic polymer materials.

An object of the invention is to construct a stringer for a slide fastener having a low cost tape.

Another object of the invention is to produce a stringer tape including plural layers of synthetic polymer films which combined have the strength, flexibility and aesthetic qualities of conventional fabric tapes.

A further object of the invention is to combine layers of different synthetic polymer materials in a stringer tape to obtain a tape with characteristics superior to those of any of the component materials alone.

DESCRIPTION OF THE PREFERRED EMBODIMENT

Figure 1:
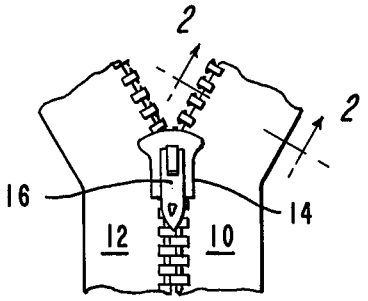
FIG. 1 is a side elevation of a slide fastener embodying the present invention.

Referring to FIG. 1, the invention is embodied in a slide fastener including a pair of stringers 10 and 12. A slider 14 having a pull tab 16 is slidably mounted on the stringers 10 and 12 to open and close the fastener by movement therealong.

Figure 2:
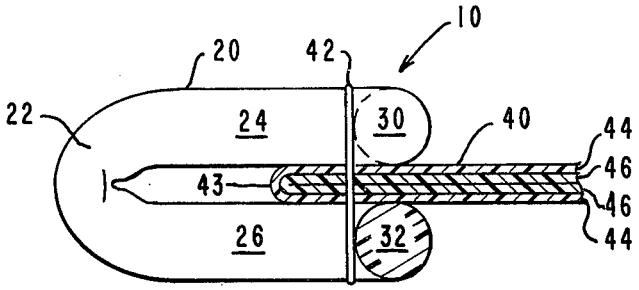
FIG. 2 is a sectional view taken along the line 2—2 in FIG. 1.

FIG. 2 shows one stringer, designated generally as 10, which includes a row of coupling elements 20 continuously joined in a meander ladder configuration. Each coupling element 20 includes a head portion 22 adapted for interengagement with the head portions of an opposing stringer (not shown). A pair of legs 24 and 26 extend in the same direction from opposite sides of each head portion 22, the legs 24 and 26 of alternate adjacent elements 20 being joined by longitudinally extending connecting portions 30 and 32 respectively.

The coupling elements 20 are attached to the edge of a tape 40 by stitching 42 which extends through the tape 40 and around both legs 24 and 26 of each element 20, bringing the legs 24 and 26 firmly to bear against opposite sides of the tape 40.

Figure 3:
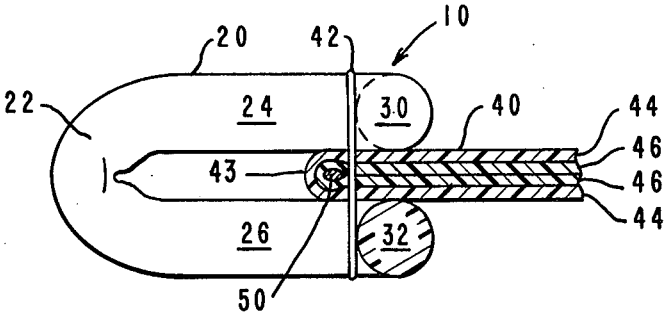
FIG. 3 is a view corresponding to FIG. 2, showing an alternative embodiment of the invention.
Figure 4:
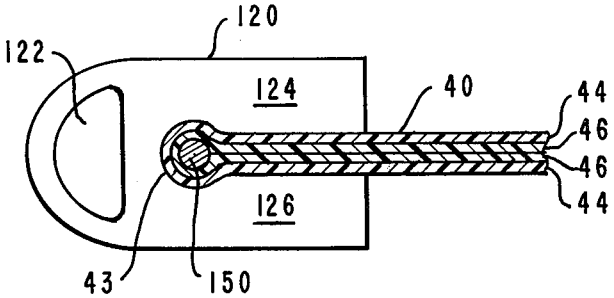
FIG. 4 is a view corresponding to FIG. 3, showing another alternative embodiment of the invention.

The tape 40, as shown in FIGS. 2–4, is preferably folded longitudinally to define a folded edge 43 that resists tearing. The coupling elements 20 being secured to the folded edge 43.

The tape 40 is composed of layers of at least two diverse non-fabric synthetic polymer materials. The term "non fabric" as used herein is intended to encompass materials other than those formed by weaving or knitting. "Diverse" should be understood to describe not only materials made from different polymers, but also those formed from the same polymer but by different methods so as to have different properties. By juciciously selecting materials, a tape having desirable qualities including low cost, strength and flexibility can be produced.

Figure 5:
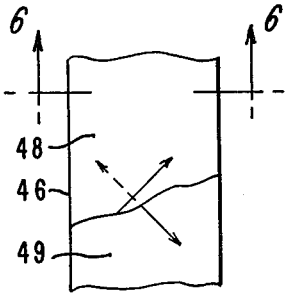
FIG. 5 is a partially broken away side elevation of a film that may be used with the invention.
Figure 6:
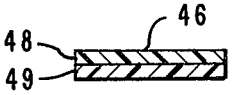
FIG. 6 is a sectional view taken along the line 6—6 in FIG. 5.

As an example, two preferred materials that are used together in practicing the invention are a layer 44 of bonded high density polyolefin fiber film, such as is sold under the trademark Tyvek, and a layer 46 of cross-laminated oriented high density polyolefin film, one such film being sold under the trademark Valeron by Van Leer Plastics, Inc. The cross-laminated film 46, which is shown as a single layer in FIGS. 2 to 4, actually includes two film plies 48 and 49 laminated together as shown in FIGS. 5 and 6. In each of the plies 48 and 49, the polymer molecules are oriented in one direction, resulting in a film having substantially greater strength in the direction of orientation than does a similar non-oriented film. The plies 48 and 49 are laminated together with their orientation directions skewed approximately 90°, as shown by the arrows in FIG. 5, producing a laminate having increased strength in both directions which provides excellent tear resistance. It is preferred that the orientation directions of the plies 48 and 49 lie at approximately 45° to the longitudinal direction of the tape 40 as shown in FIG. 5.

The tape 40, as shown in FIGS. 2–4, is preferably folded so that the outermost layer 44 is the bonded fiber material. Folded this way, the cross-laminated material forms the innermost layer 46 and provides a very strong and elastic reinforcement, while the bonded fiber material presents a dimensionally stable, textile-like cover of pleasing appearance. These materials, used in combination as above, result in a tape having strength and flexibility, as well as desirable aesthetic qualities similar to conventional fabric tapes.

FIG. 3 shows an alternative embodiment of the invention including the same elements shown in FIG. 2, plus a longitudinal reinforcing cord 50 captured within the folded edge 43 to resist tearing of the tape by the stitching 42, thereby strengthening the union between the coupling elements 20 and the tape 40.

FIG. 4 shows another embodiment of the invention wherein a row of independent metal coupling elements 120 each having a head 122 are attached as by crimping along the folded edge 43 of a tape 40 which is a laminate of non-fabric plies 44 and 46 as described for the previous embodiments. A longitudinal cord 150 is folded within the tape 40 to provide an enlarged edge 43 for grasping by the legs 124 and 126. The outer layer 44 of bonded fiber polyolefin film provides a particularly good mounting surface for the metal coupling elements 120.

It should be understood that the invention is not limited to the described embodiments, and can be practiced with stringers of varying configurations, including different polymer tape materials, various coupling element tapes and other means of attaching the elements to the tapes.

A particular advantage of the invention is that it makes feasible the construction of low-cost slide fasteners with polymer film tapes having the strength and flexibility of conventional fabric tape fasteners. Another advantage is that the invention makes it possible to use a high-strength cross-laminated film in a slide fastener tape while satisfying other design requirements including aesthetic considerations.

Since many modifications, changes in detail, and variations can be made to the described embodiments, it is intended that all matter contained in the foregoing description or the accompanying drawing shall be interpreted as illustrative and not in a limiting sense.

What is claimed is:

1. A low cost slide fastener stringer comprising a tape folded lengthwise to define a folded edge; and a row of coupling elements attached along the folded edge of the tape;

the tape including a layer of cross-laminated oriented polyolefin film, and a layer of high density polyolefin bonded fiber film;

the tape being folded so that the bonded fiber film is outermost.

2. The stringer recited in claim 1 and further including a longitudinal reinforcing cord folded within the tape to strengthen the folded edge of the tape.

3. The stringer recited in claim 2 wherein the coupling elements are made of metal, each element has a head portion with a pair of leg portions extending in the same direction from opposite sides of the head portion, and the leg portions are crimped around the folded edge of the tape to secure the element thereto.

* * * * *